United States Patent [19]

McDonald

[11] Patent Number: 4,744,545

[45] Date of Patent: May 17, 1988

[54] APPARATUS FOR DEGASSING MOLTEN METAL

[75] Inventor: Howard A. McDonald, Hendersonville, N.C.

[73] Assignee: Swiss Aluminium Ltd., Chippis, Switzerland

[21] Appl. No.: 10,463

[22] Filed: Feb. 3, 1987

[51] Int. Cl.[4] ..... C22B 9/05

[52] U.S. Cl. ..... 266/227; 266/218; 266/233

[58] Field of Search ..... 266/218, 227, 233; 75/68 R, 93 E

[56] References Cited

U.S. PATENT DOCUMENTS 4,052,199 10/1977 Mangalick ..... 75/68 R
4,177,066 12/1979 Clumpner ..... 266/227

*Primary Examiner*—L. Dewayne Rutledge
*Assistant Examiner*—Robert L. McDowell
*Attorney, Agent, or Firm*—Bachman & LaPointe

[57] ABSTRACT

Apparatus includes a chamber with an inner and outer sidewall wherein fluxing gas inlets are provided on the inner sidewall and a space is provided between the inner and outer sidewall with a heating element and an air space between the heating element and the inner sidewall for providing uniform heating of the inner sidewall.

8 Claims, 3 Drawing Sheets

APPARATUS FOR DEGASSING MOLTEN METAL

BACKGROUND OF THE INVENTION

This invention relates to an improved apparatus for degassing molten metal, and especially to a heated apparatus which obviates the necessity for draining after each use.

An improved method and apparatus for degassing molten metal is disclosed in U.S. Pat. No. 4,177,066 to Joseph A. Clumpner and assigned to the assignee of the instant invention. The disclosure in the aforenoted patent teaches degassing molten metal using an apparatus comprising a swirling tank reactor wherein molten metal is tangentially introduced into the reactor so that the molten metal flows in a swirling rotating fashion as the metal passes from the inlet of the reactor to the outlet thereof. In order to achieve the desired swirling flow of molten metal from the metal inlet to the metal outlet of the reactor, it is required that the metal inlet be positioned with respect to the chamber wall of the reactor in such a manner as to tangentially introduce the liquid into the reactor. In a preferred embodiment, the swirling tank reactor comprises a first elongated substantially cylindrical sidewall portion and a second downwardly converging sidewall portion beneath the first substantially cylindrical wall portion. Fluxing gas inlet nozzles penetrate the converging wall portion at different heights thereof so as to optimize fluxing gas bubble dispersion through the entire melt as it passes from the inlet of the reactor to the outlet thereof. By positioning the nozzles at different heights in the converging wall portion, the fluxing gas nozzles are in turn located at various distances from the center axis of the swirling tank reactor thereby maximizing fluxing gas bubble dispersion. The specific details of the various embodiments of swirling tank reactors and nozzle locations disclosed in U.S. Pat. No. 4,177,066 may readily employ the improved heated apparatus of the present invention and the disclosure of U.S. Pat. No. 4,177,066 is incorporated hereby by reference.

Additional nozzle designs are shown in U.S. Pat. No. 4,392,636 to Joseph A. Clumpner, U.S. Pat. No. 4,494,735 to Robert E. Hershey, and U.S. patent application Ser. No. 833,172, filed Feb. 26, 1986 by Howard A. McDonald (the inventor herein), now U.S. Pat. No. 4,647,018 all of which are assigned to the assignee of the instant case.

A disadvantage of current designs is that the apparatus is not heated which requires draining of the molten metal after each use. The heating of degassing apparatus presents serious potential difficulties in view of the need to maintain careful temperature control and the interrelationship with molten metal flow and fluxing gas. Moreover, it is necessary to provide a system at a low cost and compact design with moderate power demands. It is of course necessary to provide such a system without sacrificing production quality.

Accordingly, it is a principal object of the present invention to provide an improved, heated apparatus for degassing molten metal.

It is a further object of the present invention to provide an apparatus as aforesaid of compact design which efficiently maintains careful temperature control with moderate power demands.

Further objects and advantages of the present invention will appear hereinbelow.

SUMMARY OF THE INVENTION

It has now been found that the foregoing objects and advantages can be readily obtained in accordance with the present invention.

The apparatus of the present invention comprises: a chamber having an inner elongated sidewall portion and an outer elongated sidewall portion spaced therefrom; molten metal inlet means positioned at a first height with respect to said chamber to introduce molten metal into said chamber such that said molten metal flows from said molten metal inlet downwardly through said chamber; molten metal outlet means positioned at a second height below said first height for removing molten metal from said chamber; at least one fluxing gas inlet means mounted on said first inner elongated sidewall portion below said first height for introducing fluxing gas into said chamber; heating means in the space between said inner elongated sidewall portion and outer elongated sidewall portion spaced from both said inner and outer sidewall portions, insulating means between said heating means and outer sidewall portion preferably extending from the heating means to the outer sidewall portion, and an air space between said heating means and said inner elongated sidewall portion. The heating means are positioned between the metal inlet and metal outlet means. The apparatus preferably includes a drain tube beneath the metal outlet means and a riser adjacent the chamber communicating with the metal outlet means. The metal inlet means is tangentially located with respect to the chamber such that the molten metal swirlingly flows from the molten metal inlet downwardly through said chamber.

The apparatus of the present invention maintains close temperature control and has been found to be particularly advantageous for degassing aluminum, although it can be readily used with other metals. Thus, one can conveniently maintain the apparatus full of molten metal with close and effective temperature control and thereby obviate the need for draining the apparatus after each run.

Additional and significant advantages are obtained by the present apparatus. For example, the first metal out of the apparatus can be at a higher temperature than the metal at the holding furnace thereby avoiding too rapid cooling downstream. The apparatus is an efficient, low cost unit with moderate power demands. Moreover, use of the present apparatus can result in significant increases in production efficiency.

DETAILED DESCRIPTION

Figure 1:
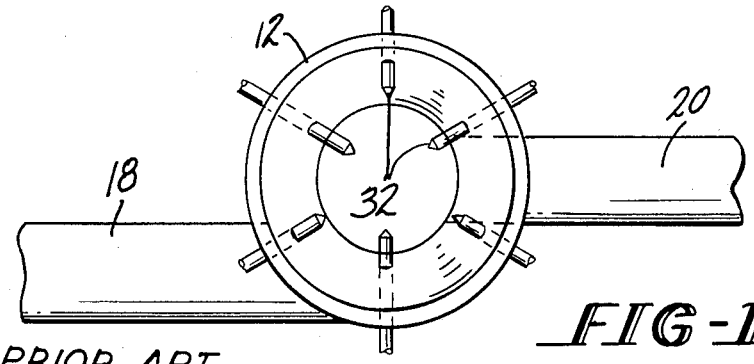
PRIOR ART FIG-1
FIG. 1 is a schematic type view of an apparatus of the present invention.
Figure 2:
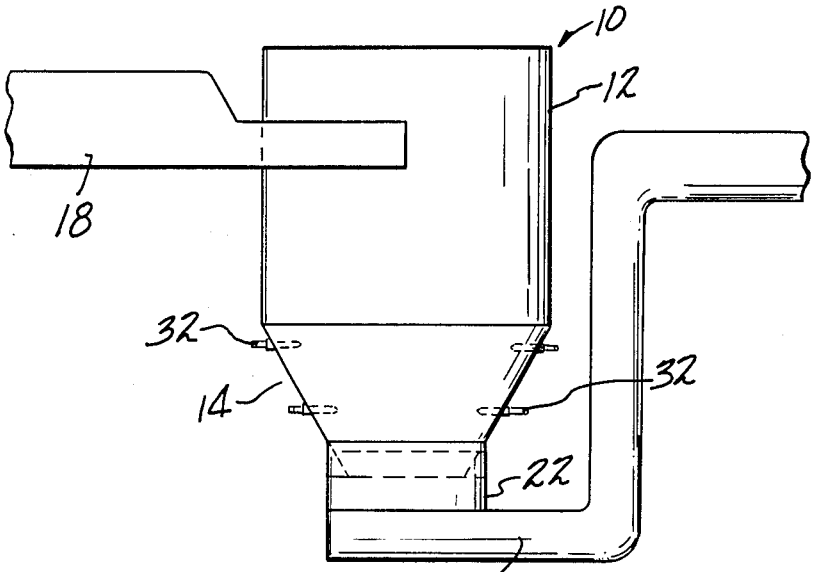
PRIOR ART FIG-2
FIG. 2 is a schematic side view of the embodiment of FIG. 1.
Figure 3:
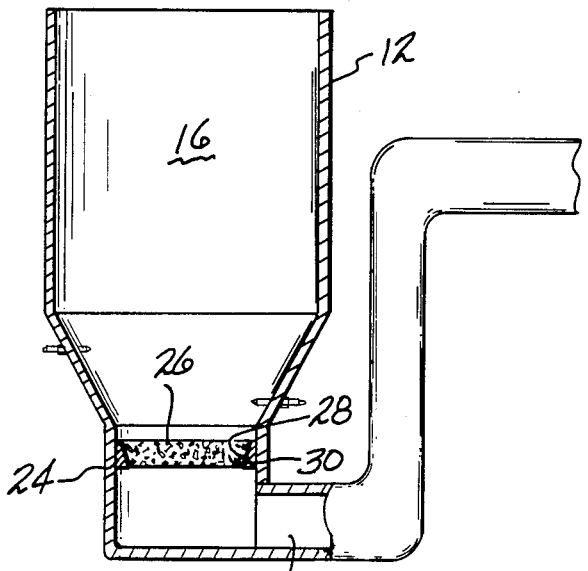
PRIOR ART FIG-3
FIG. 3 is a schematic sectional view of the embodiment of FIG. 1 without showing details of the sidewall construction but showing a filter element in place.

Referring to the drawings, the various embodiments of the apparatus of the present invention are illustrated in location as a molten metal transfer system which may include pouring pans, pouring troughs, transfer troughs, metal treatment bays or the like. FIGS. 1–3 illustrate a swirling tank reactor 10 having a first substantially cylindrical sidewall portion 12 and a second downwardly converging sidewall portion 14 which together form degassing chamber 16. While the first sidewall portion 12 is illustrated as being substantially cylindrical in shape it should be appreciated that the same could be octagonal in shape or any other shape which would allow the metal to flow in a swirling rotating fashion as it passes through the degassing chamber 16. Molten metal enters the degassing chamber 16 through molten metal inlet means 18 located at the top of the chamber 16 and positioned tangentially with respect to degassing chamber 16 and exits therefrom through molten metal outlet means 20 located at the bottom of chamber 16. Thus, the molten metal tangentially enters the degassing chamber 16 and flows in a swirling rotating fashion through chamber 16 and out the outlet 20. As illustrated in FIGS. 1–3, if desired, a substantially cylindrical sidewall section 22 may be provided beneath the downwardly sloping converging sidewall section 14 and be adapted to receive an appropriate filter type medium. As can best be seen in FIG. 3, cylindrical sidewall portion 22 is provided with a peripheral rim 24 positioned upstream of the outlet means 20 and in proximate location therewith. There peripheral rim 24 as illustrated defines a downwardly converging bevelled surface which enables the installation and replacement of an appropriately configured filter type medium 26. The filter type medium 26 has a corresponding bevelled peripheral surface 28 provided with resilient seal means 30 which is attached by means of press fit to sealingly mate with peripheral rim 24 and sidewall portion 22. It should be appreciated that the filter element need not be incorporated in the sidewall portion 22 but may be and preferably is mounted as a separate assembly downstream from the swirling tank reactor 10. In addition, an inert gaseous cover such as argon, nitrogen, etc., not shown, may be provided over the top of chamber 16 so as to minimize the readsorption of gaseous impurities at the surface of the molten metal.

The swirling tank reactor 10 is provided with a first substantially cylindrical sidewall portion 12 and a second downwardly converging sidewall portion 14 beneath sidewall portion 12 so as to form degassing chamber 16. The downwardly converging sidewall portion 14 is provided on its circumferential surface with a plurality of fluxing gas inlet nozzles 32 for introducing a fluxing gas into the molten metal as it passes through chamber 16 from the tangential inlet 18 to the outlet 20. In order to obtain optimized bubble dispersion through the entire melt as it passes from the inlet to the outlet the nozzles 32 are positioned at different heights on the circumferential surface of sidewall portion 14. In this manner, maximum fluxing gas bubble dispersion is achieved by locating the fluxing gas nozzles at various distances with respect to the central axis of the swirling tank reactor. It should be appreciated that while the fluxing gas nozzle tips are illustrated as being located in converging sidewall portion 14, like results could be obtained by locating a first set of nozzle tips in sidewall portion 12 and the second set of tips in sidewall portion 14.

The apparatus of the present invention may employ a fluxing gas such as an inert gas, preferably carrying a small quantity of an active gaseous ingredient such as chlorine or a fully halogenated carbon compound. The gas used may be any of the gases or mixtures of gases such as nitrogen, argon, chlorine, carbon monoxide, Freon 12, etc., that are known to give acceptable degassing. In a preferred embodiment for the degassing of molten aluminum melts, mixtures of nitrogen-dichlorodifluoromethane, argon-dichlorodifluoromethane, nitrogen-chlorine or argon-chlorine may be used.

Figure 4:
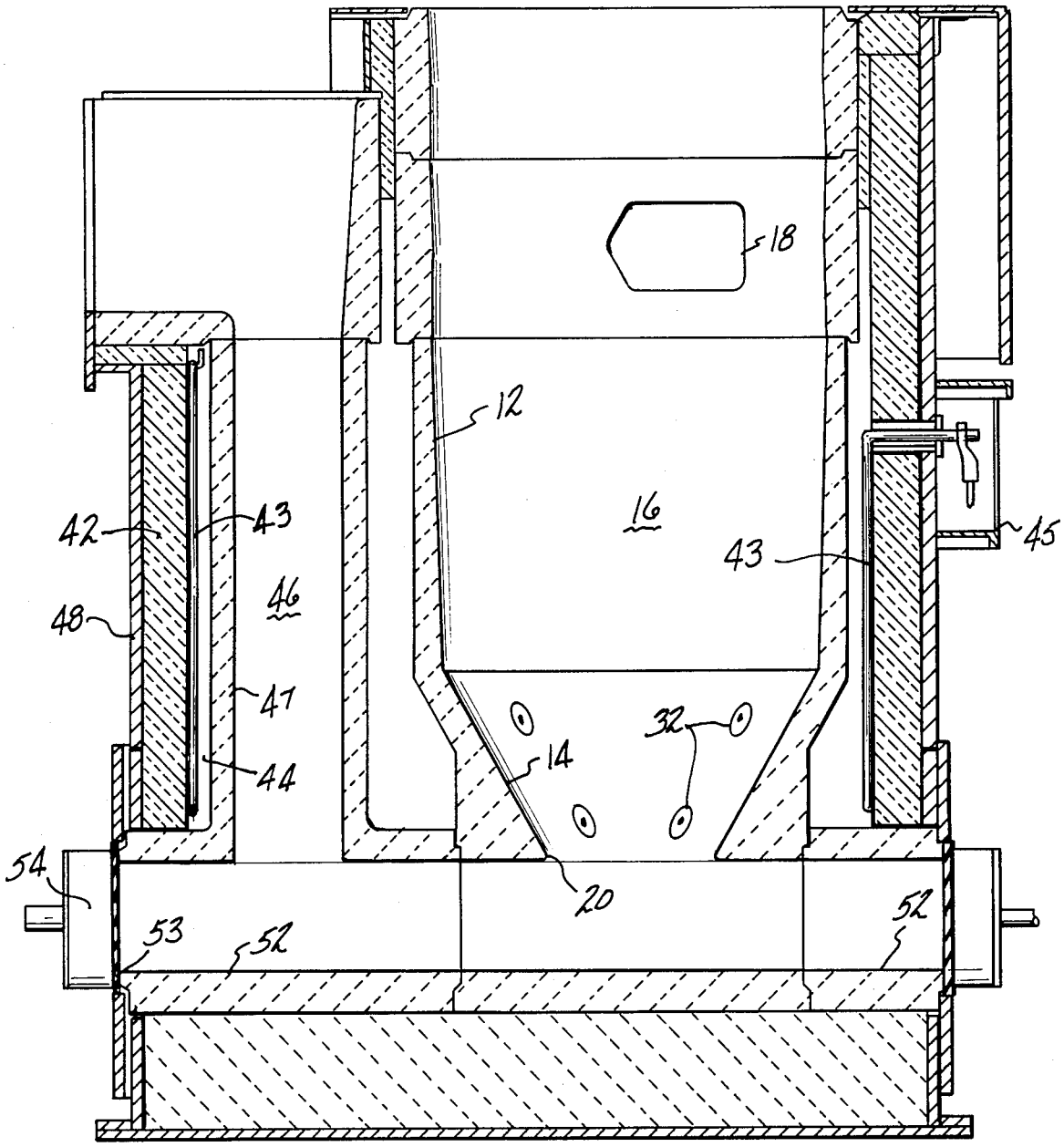
FIG. 4 is a sectional view of the apparatus of the present invention.
Figure 5:
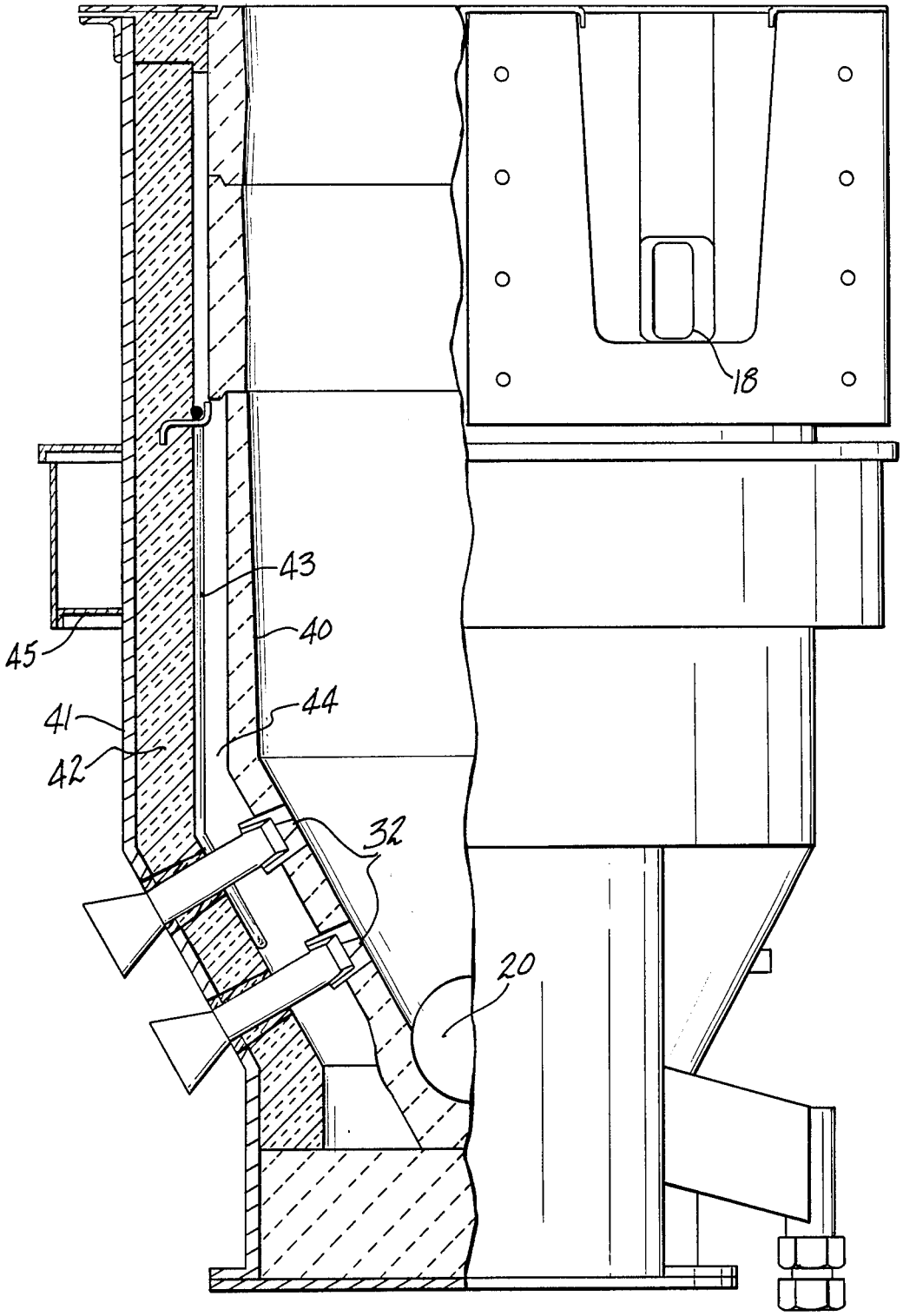
FIG. 5 is a front view of the apparatus of FIG. 4 with portions in section.

Referring to the detailed embodiment of FIGS. 4 and 5, degassing chamber 16 is provided with an inner elongated sidewall portion 40 and an outer elongated sidewall portion 41 spaced from the inner sidewall. Molten metal inlet 18 is tangentially positioned at a first height with respect to chamber 16 to introduce molten metal into chamber 16 such that the molten metal flows downwardly in a swirling manner through said chamber. Metal outlet 20 is positioned at a second height below the first height for removing molten metal from chamber 16. It is noted that the embodiment of FIGS. 4–5 does not include a filter medium which, if used, is preferably employed downstream from the reactor.

A plurality of fluxing gas nozzles 32 are mounted on inner sidewall portion 40 below metal inlet 18 and above metal outlet 20 for introducing fluxing gas into chamber 16 in counter-current relationship to the molten metal as it flows downwardly in a swirling manner from inlet 18 to outlet 20. The number of nozzles will naturally depend on the size of the unit, with 2 to 30 being quite suitable. Six or eight have been found to give excellent results.

Inner sidewall portion 40 should be constructed of a suitable material which is resistant to molten metal, such as a refractory material as alumina, or silicon carbide. Outer sidewall portion 41 should be constructed of a suitable high strength metal, as steel. The inner and outer sidewalls are spaced apart with insulating material 42 placed therebetween.

In accordance with the present invention heating means 43 is placed in the space between the inner and outer sidewalls spaced from both the inner and outer sidewalls as clearly shown in FIGS. 4–5. Insulating material 42 is placed between heating means 43 and outer sidewall 41, preferably filling the entire space therebetween, and an air space or heating space 44 is provided between heating means 43 and inner wall 40. A plurality of heating means 43 are provided depending upon the size of the unit. Spacing the heating means 43 from inner wall 40 with an air space therebetween has been found to provide surprisingly effective and uniform heating despite the difficult conditions of this degassing apparatus.

The heating means 43 are positioned between the inlet 18 and outlet 20. Although any suitable heating element can be used, a typical element is a large diameter, nickel-chromium element operating at a maximum of 45 volts, 3 phase, 60 HZ power input. The heating elements are connected to a power supply (not shown) via raceway 45, with a typical power supply being 480 volts, 3 phase 60 HZ with stepdown transformers to provide low voltage and high amperage power to the heating elements.

Outlet 20 is connected to an integral riser 46 and thence to the casting station, including an intermediate filter if used. In the preferred embodiment of FIGS. 4–5, the integral riser is adjacent chamber 16 with an inner riser wall 47, outer riser wall 48, heating element 43 spaced from both the inner and outer riser walls, insulating means 42 between heating element 43 and outer riser wall 48, and an air space 44 between the heating element 43 and inner riser wall 47 to provide a heated riser. Drain tube 52 is provided beneath outlet 20 with drain opening 53 and openable closure means 54, preferably with two drain openings and two openable closure means as shown in FIG. 4 for ease of cleaning.

The apparatus of the present invention has been found to obtain significant advantages. The apparatus is compact in size and versatile in design. Moreover, the heated chamber of the apparatus keeps maintenance costs at low levels, simplifies operation procedures and improves production efficiency. Moreover, it has been found that the energy costs are surprisingly low.

In operation, the apparatus readily maintained metal temperature at 1275° F. to 1300° F. while the shell temperature was about 200° F. In operation, the temperature of the empty chamber was stabilized before filling with molten metal. Once filled, the temperature of the filled chamber was adjusted to the temperature needed for the start of the casting. As the casting begins, the gas flow is increased from an idle condition to a flux condition. At the end of the cast, the gas flow is returned to the idle condition. Should nozzle replacement become necessary, it can normally be done in a few minutes following draining of the system. The temperature can be maintained during this time which permits the nozzle replacement to be done at any scheduled draining of the system.

Testing of the system showed that the system was simple and safe to operate and resulted in significant production improvements while maintaining uniform temperature control. Significant production efficiencies were obtained. In addition, Telegas data during degassing of alloy 7050 showed that incoming hydrogen content of about 0.15 cc/100 g of aluminum was reduced to about 0.05 cc/100 g at the outlet of the reactor using argon only for a 62% removal efficiency. The argon gas flow was 0.74 liters per pound of aluminum. This is a high percentage of hydrogen removal, particularly for the low incoming hydrogen content of the metal and represents a surprisingly effective result.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for use in degassing molten metal which comprises: a chamber having an inner elongated sidewall portion and an outer elongated sidewall portion spaced therefrom; molten metal inlet means positioned at a first height with respect to said chamber to introduce molten metal into said chamber such that said molten metal flows from said molten metal inlet downwardly through said chamber; molten metal outlet means positioned at a second height below said first height for removing molten metal from said chamber; at least one fluxing gas inlet means mounted on said first inner elongated sidewall portion below said first height for introducing fluxing gas into said chamber; and heating means in the space between said inner elongated sidewall portion and outer elongated sidewall portion spaced from both said inner and outer sidewall portions, insulating means between said heating means and outer sidewall portion, and an air space between said heating means and said inner elongated sidewall portions for providing uniform heating of said inner elongated sidewall portion.

2. An apparatus according to claim 1 wherein said insulating means extend from said heating means to said outer elongated sidewall portion.

3. An apparatus according to claim 1 wherein said heating means are positioned between said metal inlet means and metal outlet means.

4. An apparatus according to claim 1 including a drain tube beneath said metal outlet means.

5. An apparatus according to claim 4 wherein said drain tube includes two spaced drain openings each of which includes closure means.

6. An apparatus according to claim 1 including a molten metal riser adjacent said chamber communicating with said molten metal outlet means.

7. An apparatus according to claim 6 wherein said riser includes an inner elongated riser sidewall portion and an outer elongated riser sidewall portion spaced therefrom with heating means in the space between said inner elongated riser sidewall portion and outer elongated riser sidewall portion spaced from both said inner and outer riser sidewall portions.

8. An apparatus according to claim 1 wherein said metal inlet means is tangentially located with respect to said chamber such that said molten metal swirlingly flows from said molten metal inlet downwardly through said chamber.

* * * * *